United States Patent [19]

Isogai

[11] Patent Number: 4,856,618

[45] Date of Patent: Aug. 15, 1989

[54] MECHANISM FOR PREVENTING A CARRIAGE OF A SYSTEM FOR LIFTING A VEHICLE FOR REPAIR THEREOF FROM LOWERING

[75] Inventor: Shunji Isogai, Hekinan, Japan

[73] Assignee: Sugiyasu Industries Co., Ltd., Japan

[21] Appl. No.: 146,225

[22] Filed: Jan. 20, 1988

[30] Foreign Application Priority Data

Aug. 25, 1987 [JP] Japan ..... 62-128947

[51] Int. Cl.[4] ..... B66F 7/00

[52] U.S. Cl. ..... 187/8.5; 254/89 H

[58] Field of Search ..... 187/8.5, 8.49, 8.47; 254/2 C, 4 R, 4 C, 93 R, 93 L, 89 H; 182/141

[56] References Cited

U.S. PATENT DOCUMENTS

| | | | |
|---|---|---|---|
| 2,849,084 | 8/1958 | Hott et al. | 187/8.5 |
| 4,331,219 | 5/1982 | Suzuki | 187/8.5 |
| 4,638,886 | 1/1987 | Marietta | 187/8.5 |

*Primary Examiner*—Joseph J Rolla

*Assistant Examiner*—Kenneth Noland

*Attorney, Agent, or Firm*—Lahive & Cockfield

[57] ABSTRACT

A system for lifting a vehicle for repair thereof includes at least a pair of opposed posts each having a carriage connected thereto and having an inner space wherein a vertical cylinder with a piston rod is disposed. A deflecting member is connected to the top of the piston rod. The carriage is interconnected to the piston rod by device of a connecting means which has one end fixed to the carriage and another end fixed to the inner surface of the post and also has a portion fitted on the deflecting member. In the inner space of the post, a rack is connected to the piston rod in parallel therewith. A locking member is connected to a horizontal shaft extending through and rotatably supported by a bracket which is fixed to the outside of the post. The locking member projects into the post through an opening which is made through the wall of the post, and engages the rack. A lever is interconnected to the locking member for disengaging the locking member from the rack.

1 Claim, 3 Drawing Sheets

MECHANISM FOR PREVENTING A CARRIAGE OF A SYSTEM FOR LIFTING A VEHICLE FOR REPAIR THEREOF FROM LOWERING

FIELD OF THE INVENTION

This invention relates to a mechanism for preventing a carriage of a system for lifting a vehicle for repair thereof from lowering.

BACKGROUND OF THE INVENTION

In a lift system operated by a piston cylinder, especially in a vehicle lift system, if the hydraulic pressure is reduced, for example, due to a defect in a sealing element or a packing or due to a damage to a pipe, the carriages may lower suddenly and the object lifted may drop. Such an accident may kill the operator of the lift system.

Heretofore, in the field of vehicle lifts, such a danger has been eliminated by connecting a vertical rack 7' to each post of the lift and mounting a locking member 10 on the carriage which is adapted to engage the rack to prevent the carriage from lowering in case of a reduction of the hydraulic pressure. A lever is connected to the locking member 10 for manually disengaging the member 10 from the rack.

In the conventional mechanism for preventing a carriage from lowering, however, since the locking member 10 is mounted on the carriage, the lever connected to the member 10 is vertically moved together with the carriage, and when the carriage is in its uppermost or lowest position, the lever is not easy to operate. Also, when the vehicle is being lifted, the carriage with the locking member may be inclined due to the weight of the vehicle with the result that the locking member may be disengaged from the rack. Also, a complex interlocking mechanism is required to simultaneously disengage the vertically-movable locking members mounted on the respective carriages from the associated racks in given levels.

SUMMARY OF THE INVENTION

The object of the invention is to provide a mechanism for preventing a carriage of a system for lifting a vehicle for repair thereof from lowering which is free from the foregoing disadvantages of the conventional mechanism.

DETAILED DESCRIPTION OF THE PREFERRED EMBODIMENT

Figure 1:
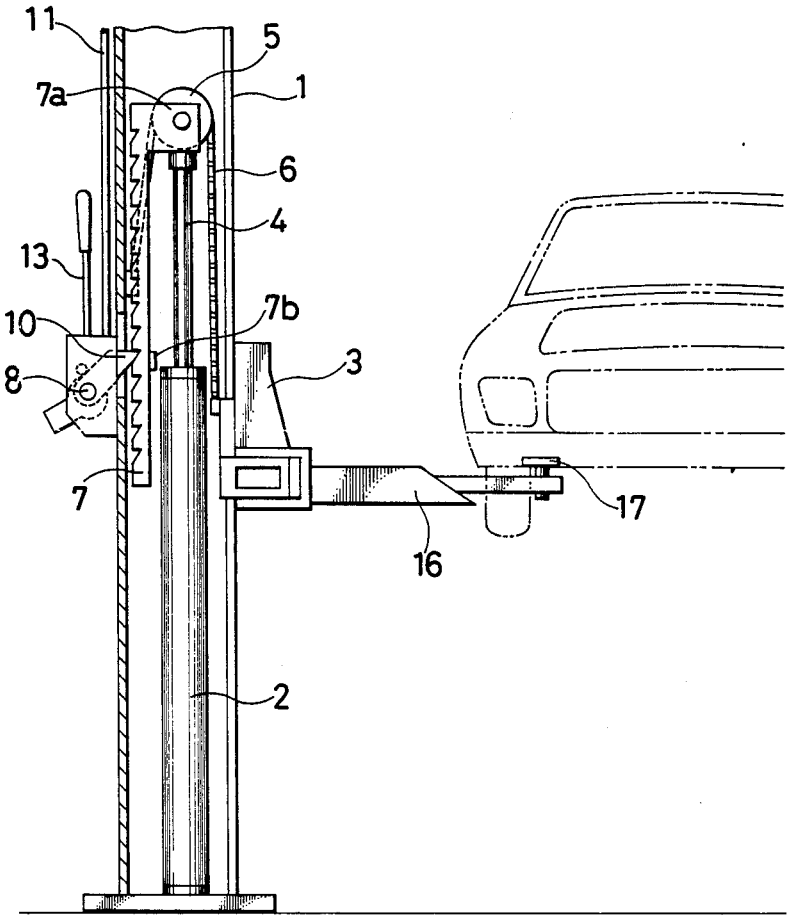
FIG. 1 shows one post of a 2-post vehicle lift which is provided with a mechanism of the invention.
Figure 2:
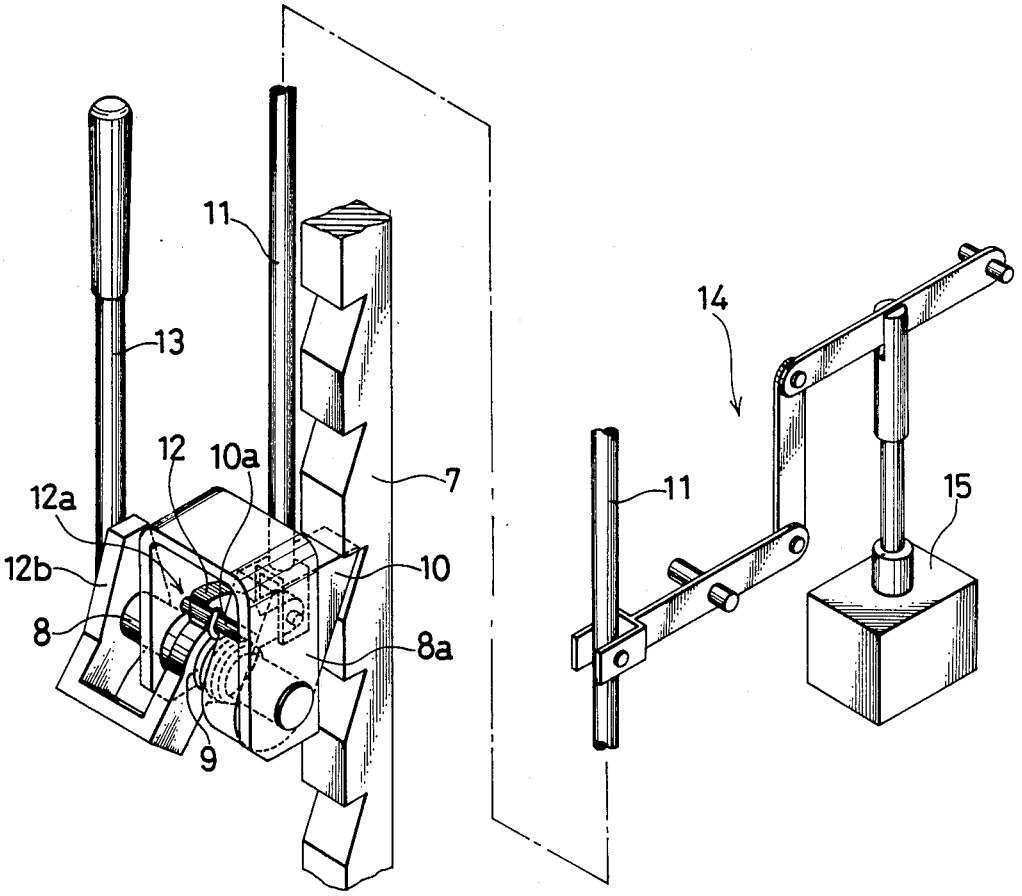
FIG. 2 shows different portions of the mechanism.
Figure 3:
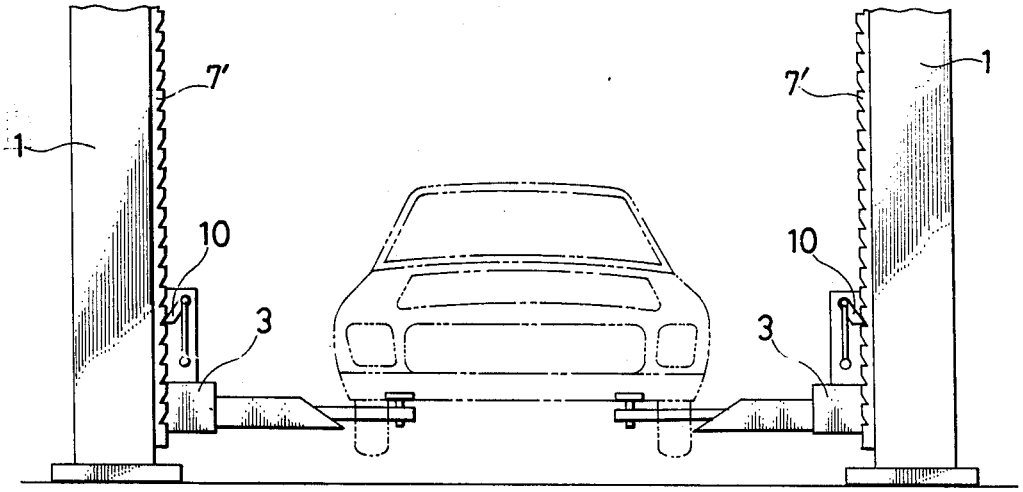
FIG. 3 (PRIOR ART)
FIG. 3 shows a conventional mechanism.

A mechanism for preventing a carriage of a system for lifting a vehicle for repair thereof from lowering according to the invention will now be described with reference to the drawing.

In the drawing the mechanism of the invention is used for a 2-post lift system. Although FIG. 1 shows only one 1 of the two posts with the mechanism, the other post not shown is also provided with the same mechanism. Each post has an inner space.

A vertically-movable carriage 3 is connected to the post 1. A horizontal support arm 16 is connected to the carriage 3. The arm 16 has a means 17 for directly supporting the bottom of a vehicle. A vertical cylinder 2 is provided within the post 1. The cylinder 2 has a piston rod 4. The piston rod 4 has a top with a rotatable wheel 5. A chain 6 is fitted on the wheel 5. The chain 6 is connected to the inside of the outer wall of the post 1 at one end thereof and to the carriage 3 at an opposite end thereof in such a manner that, when the chain 5 is moved by actuating the piston rod 4, the carriage 3 is moved at twice the speed of actuation of the rod 4. The piston rod 4 is actuated synchronously with that of the other post. Inside the post 1, a vertical rack 7 is connected, at its top, to the top of the piston rod 4 by means of a connecting member **7*a*. In other words, the rack 7 is suspended from the top of the rod 4. The rack 7 is parallel to the rod 4. Also, the rack 7 has a surface which faces the inside of the outer side wall of the post 1 and is toothed to provide a plurality of notches. A horizontal bar 7*b* extends in parallel with the inner and outer side walls of the post, and contacts the surface of the rack 7 opposite to the toothed surface thereof. This bar 7*b* has one end connected to the rear wall of the post and an opposed end connected to the front wall thereof. The bar 7*b* serves to prevent the suspended rack 7 from dangling. A generally inverted U-shaped bracket 8*a* is fixed to the outside of the outer wall of the post 1. A rotatable horizontal shaft 8 extends through the bracket 8*a*. A locking member 10 and an arm 12 are connected to the shaft 8. The locking member 10 has a portion which is shaped to fit into each notch of the rack 7. The outer side wall of the post 1 has an opening at a portion thereof which is adjacent to the bracket 8*a*(FIG. 1). From this opening projects the foregoing portion of the locking member 10. A horizontal rod 10*a* is secured to the portion of the locking member 10 which does not project from the foregoing opening. The arm 12 has a recess 12*a* which receives part of the circumference of one end portion of the rod 10*a*. A spring 9 is provided around the shaft 8, and urges the rod 10*a* in such a direction that the locking member 10 engages the toothed surface of the rack 7. A vertical interlocking rod 11 extends along the outer wall of the post 1, and is connected, at its lower end, to one end of the arm 12. Since the spring 9 urges not only the locking member 10, but also the arm 12 via the rod 10*a*, the interlocking member 11 is pulled in a downward direction. The arm 12 is connected to a plate 12*b* which is connected to one end of the shaft 8 and is parallel to the arm 12. A lever 13 is connected to the plate 12*b*. When the lever 13 is manually inclined to the side opposite to that of the post 1, not only the locking member 10 is disengaged from the rack 7, but also the interlocking rod 11 is raised. The interlocking rod 11 is interconnected to that provided in conjunction with the other, opposed post (not shown) in such a manner that the two interlocking rods are raised or lowered in a simultaneous manner. A valve 15 is connected to the upper portion of the interlocking rod 11 by means of a link 14. When the interlocking rod 11 is raised, the valve 15** is opened.

In use, when a hydraulic pressure is applied to the cylinder 2, the piston rod 4 is extended to move both the chain 6 and the rack 7 upwardly. The upward movement of the chain 5 causes the carriage 3 to be raised. The locking member 10 engages the toothed surface of the rack 7 at all times, and when the rack is raised, the toothed surface thereof slides on the member 10. And when the rack is stopped, the member 10 engages one of the notches of the rack to lock the rack. The carriage 3 is thus prevented from lowering.

When the carriage 3 is to be lowered, the lever 13 is manually inclined to disengage the locking member 10 from the notch of the rack 7 and to open the valve 15. When the valve 15 is opened, the hydraulic pressure is released from the cylinder 2. The carriage 3 is thus lowered.

When the lever 13 is inclined, the two locking members provided in conjunction with the respective posts are simultaneously disengaged from the associated racks because the two interlocking rods are simultaneously raised.

According to the invention, the locking member 10 is not connected not to the carriage 3, but to the shaft 8 which is a member separate from the carriage. Therefore, if the carriage is inclined due to the weight of the vehicle supported by the member connected to the carriage, there is no possibility that the locking member 10 may be disengaged from the notch of the rack. Also, the lever 13 is connected not to the vertically-movable carriage 3, but to the shaft 8 (through the plate 12*b*) which is member rotatable, but not movable relative to the post. Therefore, the manual operation of the lever for disengaging the locking member 10 from the notch of the rack can be made at the constant level.

Also, since the locking member 10 is connected to the shaft 8 which is not movable relative to the post, the locking members provided in conjunction with the respective posts may be interlocked in a simple manner (by means of the interlocking rods). Moreover, the lever 13 is interconnected not only with the locking member 10, but also with the valve 15. As mentioned before, the interconnection of the lever with the valve 15 is such that the operation of the former causes the latter to be opened. Therefore, the mere operation of the lever causes the carriage 3 to be lowered with certainty.

Also, if, when the carriage is in a raised position, the hydraulic pressure in the cylinder 2 should be reduced to such a degree that the pressure can no longer keep the piston rod in the raised position, the rod is certainly prevented from lowering because the the locking member 10 engages the rack.

Also, since the locking member 10 is urged against the rack at all times, there is no fear of the failure to lock the rack.

The mechanism of the invention thus provides a high degree of convenience, safety and reliability in use, and is of great value for the vehicle lift industry.

If desired, a sprocket or a pulley may be used instead of the wheel 5. Also, a rope or a cable may be used instead of the chain 6.

If desired, the rack may be connected, not at its top but at its portion slightly lower than its top, to the top of the piston rod 4 by means of a member similar to the connecting member *7a*.

It will be appreciated that the mechanism of the invention may be used not only for a 2-post lift, but also for a gate-shaped lift or a 4-post lift.

What is claimed is:

1. In a system for lifting a vehicle for repair thereof which includes at least a pair of opposed posts each having a carriage connected thereto and having an inner space wherein a vertical cylinder with a piston rod is disposed, a deflecting member being connected to the top of the rod, and the carriage being interconnected to the piston rod by means of a connecting means which has one end fixed to the carriage and another end fixed to the inner surface of the post and also has a portion fitted on the deflecting member, the interconnection of the carriage to the piston rod being such that the carriage is vertically moved when the piston rod is actuated, a mechanism for preventing the carriage from lowering from a raised position which includes (a) a rack provided in the inner space of the post and connected to the piston rod in parallel therewith, (b) a horizontal shaft extending through and rotatably supported by a bracket which is fixed to the outside of the post, (c) a locking member having one end portion fixed to a first end of the shaft and a distal end portion projecting into the post through an opening which is made through the wall of the post, (d) means for urging the distal end portion of the locking member against the rack so as to lock the rack, (e) a lever with one end fixed to a second end of the locking member for rotating the shaft so as to disengage the locking member from the rack, (f) interlock means interconnected to a middle portion of the shaft for simultaneous movement with the shaft, and (g) a valve connected to the shaft through the interlock means and to open to release a hydraulic pressure from the cylinder when the lever is operated to disengage the locking member from the rack.

* * * * *